US005456084A

United States Patent [19]

Lee

[11] Patent Number: 5,456,084

[45] Date of Patent: Oct. 10, 1995

[54] CRYOGENIC HEAT EXCHANGE SYSTEM AND FREEZE DRYER

[75] Inventor: Ron C. Lee, Bloomsbury, N.J.

[73] Assignee: The BOC Group, Inc., New Providence, N.J.

[21] Appl. No.: 143,723

[22] Filed: Nov. 1, 1993

[51] Int. Cl.[6] ..... F17C 9/02; F04B 37/08; F25B 19/00

[52] U.S. Cl. ..... 62/51.1; 62/50.2; 62/272; 62/500

[58] Field of Search ..... 62/50.2, 50.3, 62/55.5, 272, 500, 51.1

[56] References Cited

U.S. PATENT DOCUMENTS

| | | | |
|---|---|---|---|
| 3,058,317 | 10/1962 | Putman | 62/50.2 |
| 3,091,096 | 5/1963 | Rendos et al. | 62/50.2 |
| 3,572,048 | 3/1971 | Murphy | 62/50.2 |
| 3,712,074 | 1/1973 | Boissin | 62/55.5 |
| 3,726,101 | 4/1973 | Arenson | 62/50.2 |
| 3,733,838 | 5/1973 | Delahunty | 623/500 X |
| 3,788,096 | 1/1974 | Brilloit | 62/55.5 |
| 4,399,658 | 8/1983 | Nielsen | 62/50.2 |
| 4,399,659 | 8/1983 | Strigl | 62/50.2 |
| 4,637,216 | 1/1987 | Shenoy et al. | 62/500 X |

FOREIGN PATENT DOCUMENTS

| | | | |
|---|---|---|---|
| 4316794 | 11/1992 | Japan | 62/50.3 |

OTHER PUBLICATIONS

SAE Technical Paper 911558–Development Of A Recirculation Ejector For A Cryogenic Heat Sink For Eclss–James Fr. Fort and Michael J. Heldmann–Jul. 1991.

*Primary Examiner*—Christopher Kilner

*Attorney, Agent, or Firm*—David M. Rosenblum; Larry R. Cassett

[57] ABSTRACT

A cryogenic heat exchange system and freer dryer incorporating the same. The cryogenic heat exchange system has a heat exchanger provided with at least one pass for receiving a cryogenic heat exchange fluid. A reversing circuit is provided to reverse the flow direction of the cryogenic heat transfer fluid in the at least one pass to help prevent asymmetric ice buildup on the heat exchanger. Additionally, a portion of the spent cryogenic heat transfer fluid after having passed through the at least one pass is recirculated. During the recirculation, the spent cryogenic heat transfer fluid is mixed with incoming cryogen to produce the cryogenic heat transfer fluid. Such cryogenic heat transfer fluid after creation is then introduced into the flow reversing circuit and the one or more passes of the heat exchanger. A remaining portion of the cryogenic heat transfer fluid is vented. The recirculation raises the temperature of the heat transfer in the heat exchanger to also promote uniform ice buildup. The heat exchanger can be a condenser used in a freeze drier for freezing water vapor sublimated during the freeze drying process. Additionally, in a proper application of the present invention, the reversal coupled with the recirculation and mixing can be used to provide the cryogenic heat exchange system with a self-defrost capability.

10 Claims, 1 Drawing Sheet

CRYOGENIC HEAT EXCHANGE SYSTEM AND FREEZE DRYER

BACKGROUND OF THE INVENTION

The present invention relates to a cryogenic heat exchange system in which a cryogenic heat transfer fluid is circulated through one or more passes of the heat exchanger in order to cool a heat load. Additionally, the present invention relates to a freeze dryer employing the cryogenic heat exchange system wherein the cryogenic heat transfer fluid is circulated through a condenser utilized in condensing sublimated water vapor.

Cryogenic heat exchangers are attractive design alternatives from the standpoint that they do not use environmentally damaging refrigerants, but instead use a cryogenic heat transfer fluid such as a liquefied atmospheric gas. Additionally, such cryogenic heat exchangers provide much greater flexibility in the amount of cooling provided and can reach colder temperatures than heat exchangers utilizing conventional refrigerants. It has been found, however, that it is difficult to build such a heat exchanger in a compact fashion because as the cryogenic heat transfer fluid enters the heat exchanger, more ice will build up on the side of the heat exchanger at which the cryogenic heat transfer fluid enters the heat exchanger. The section of the heat exchanger at which the ice has built up will be relatively ineffective as compared to the remainder of the heat exchanger. The ice itself may be unacceptable in come cases, such as in chilling liquids, or may block the heat exchanger. Still another problem is that there is very little control over the temperature of the heat exchanger. Assuming, liquid nitrogen were used as the cryogenic heat transfer fluid, the inlet to the heat exchanger would cool to temperatures of about 77K. Such cooling would damage certain types of food products and in any event would be inefficient when the article to be cooled were only required to be cooled to about the freezing point of water.

As will be discussed, the present invention provides a cryogenic heat exchange system in which ice build-up on a heat exchanger employed in the cryogenic heat exchange system is more uniform (and possibly prevented altogether) as compared with that of prior art heat exchangers which utilize a cryogenic heat exchange fluid. Moreover, the present invention provides a cryogenic heat exchange system wherein the temperature at which heat transfer takes place can be controlled.

SUMMARY OF THE INVENTION

The present invention provides a cryogenic heat exchange system. The cryogenic heat exchange system comprises a heat exchanger having at least one pass for receiving a cryogenic heat exchange fluid. A reversing circuit is connected to the at least one pass and has an inlet for receiving the cryogenic heat exchange fluid. The reversing circuit is also provided with a means for introducing the cryogenic heat transfer fluid into the at least one pass and for reversing the flow direction of the cryogenic heat transfer fluid so that the cryogenic heat transfer fluid flows through the at least one pass in one flow direction and then in an opposite flow direction. An outlet of the reversing circuit is provided for receiving a portion of the cryogenic heat transfer fluid from the at least one pass after having passed therethrough as spent cryogenic heat exchange fluid. A recirculation means is connected to the outlet of the reversing circuit for receiving the spent cryogenic heat exchange fluid. The recirculation means has a mixing chamber for mixing the spent cryogenic heat transfer fluid with a cryogen to form the cryogenic heat exchange fluid and thereby to increase the enthalpy of the cryogenic heat transfer fluid over that of the cryogen. It is to be noted that the term "cryogen" as used herein and in the claims means a substance existing as a liquid or a solid at temperatures well below those normally found in ambient, atmospheric conditions. Examples of cryogens are liquefied atmospheric gases, for instance, nitrogen, oxygen, argon, carbon dioxide and etc. A mixing chamber outlet is provided in communication with the inlet of the reversing circuit for introducing the cryogenic heat transfer fluid into the reversing circuit. A means is provided for circulating the cryogenic heat transfer fluid to the reversing circuit, through the at least one pass of the heat exchanger, and back to the mixing chamber as the spent cryogenic heat exchange fluid. A vent means is provided for venting a remaining portion of the cryogenic heat transfer fluid after having passed through the at least one pass of the heat exchanger.

The reversing of the flow direction of the cryogenic heat transfer fluid will cause ice to accumulate in uniform amounts on at least the ends of the heat exchanger. At intermediate points, between the ends of the heat exchanger, more ice might build up than on the ends of the heat exchanger. In order to minimize ice build up between the ends of the heat exchanger, the enthalpy of the incoming cryogenic heat transfer fluid is increased by recirculating a portion of the spent cryogenic heat transfer fluid and mixing it with incoming cryogenic liquid to raise the average temperature at which the heat transfer takes place. The reversing flow coupled with the enthalpy boost can in appropriate applications of the present invention be used as a self-defrost feature where ice build-up in any amount is unacceptable. It is to be noted here that the discussion of the heat exchanger with respect to "ice build-up" or "frost" is not meant to limit the field of use of the present invention to instances in which water freezes. The ice or frost in other applications, for instance, food chilling or freezing, could be carbon dioxide as well as other ice or frost forming substances connected with the particular application of the present invention.

In another aspect, the present invention provides a freeze dryer comprising a freeze drying chamber for subjecting substances to a freeze drying process in which moisture contained within the substances is frozen and sublimated into a vapor. A condenser is provided in communication with the freezing chamber for freezing the evolved vapor and for accumulating the frozen vapor as ice. The condenser has at least one pass for receiving a cryogenic heat exchange fluid. A reversing circuit is connected to the condenser and has an inlet for receiving the cryogenic heat exchange fluid. The reversing circuit is also provided with a means for introducing the cryogenic heat transfer fluid into the at least one pass of the condenser and for reversing flow direction of the cryogenic heat transfer fluid so that the cryogenic heat transfer fluid flows through the at least one pass in one flow direction and then in an opposite flow direction. The reversal of flow promotes a uniform accumulation of ice on the condenser. An outlet is provided for receiving a portion of the cryogenic heat transfer fluid from the condenser as spent cryogenic heat exchange fluid. A recirculation means is connected to the outlet of the reversing circuit for receiving the spent cryogenic heat exchange fluid. The recirculation means has a mixing chamber for mixing the spent cryogenic heat transfer fluid with a cryogen, thereby to form the cryogenic heat transfer fluid and to increase the enthalpy of the cryogenic heat transfer fluid over that of the cryogen. A mixing chamber outlet is provided in communication with the inlet of the reversing circuit for introducing the cryogenic heat transfer fluid into the reversing circuit. A means is provided for recirculating the cryogenic heat transfer fluid to the reversing circuit, through the at least one pass of the condenser, and back to the mixing chamber as spent cryogenic heat exchange fluid. A vent means is provided for venting a remaining portion of the cryogenic heat transfer fluid after having passed through the at least one pass of the condenser.

BRIEF DESCRIPTION OF THE DRAWINGS

While the specification concludes with claims distinctly pointing out the subject matter that Applicant regards as his invention, it is believed the invention will be better understood when taken in connection with the accompanying drawings in which the sole FIGURE is a schematic of a cryogenic heat exchange system of the present invention utilized within a condensing section of a freer dryer also in accordance with the present invention.

DETAILED DESCRIPTION

Figure 1:
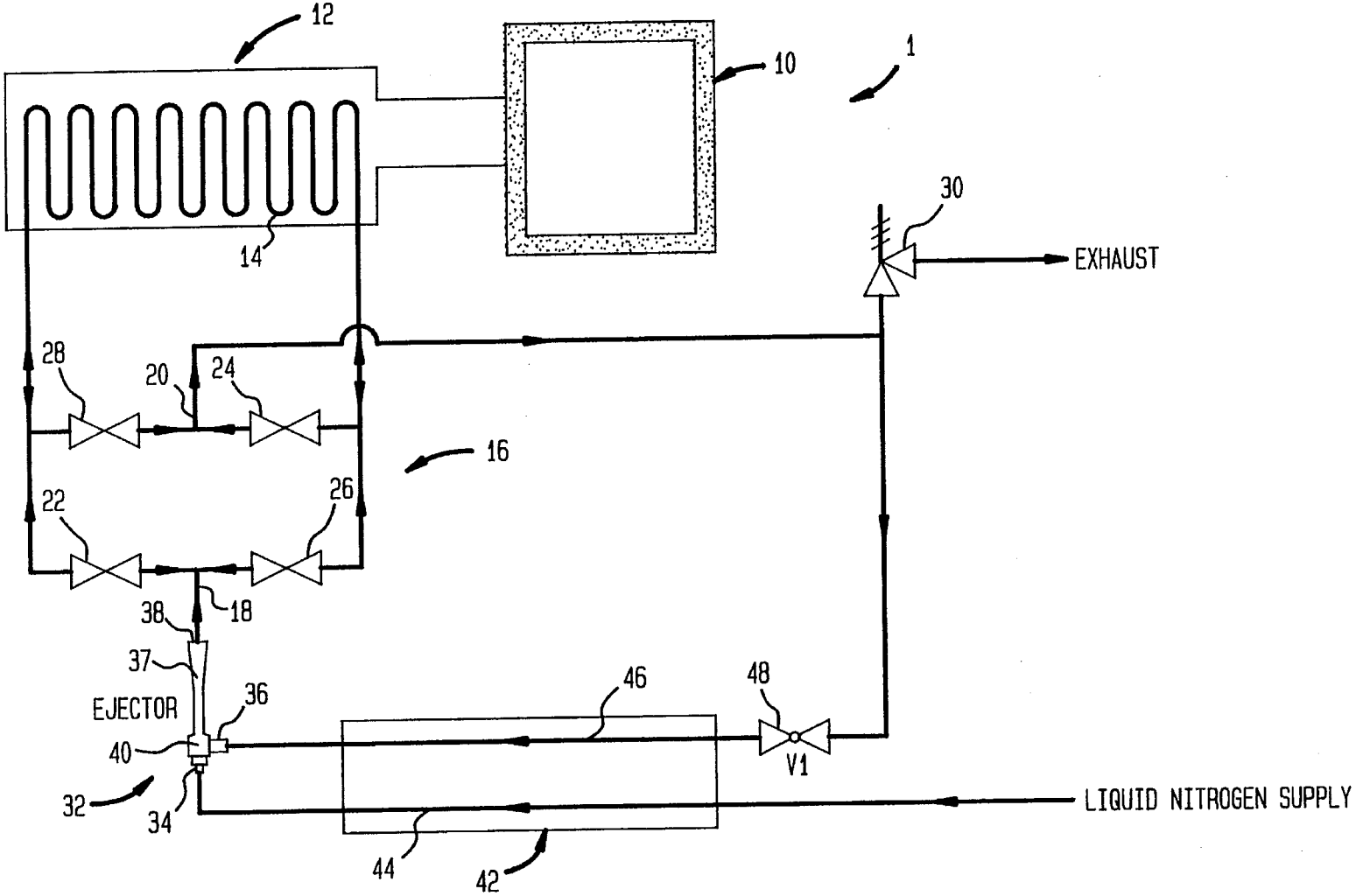

With reference to the FIGURE, a freer dryer 1 is illustrated as employing a freeze drying chamber 10 within which substances are subjected to a freeze drying process and a condenser 12 which form part of a cryogenic heat transfer system. In the freer drying process, substances are placed within a freeze drying chamber 10. In the freer drying process, the substances are frozen on the shelves by circulating a refrigerant through passages provided within the shelves. Thereafter, the pressure within the freeze dryer is sufficiently reduced until the frozen moisture sublimates into a vapor. The vapor is drawn into condenser 12 on which it is frozen.

Condenser 12 is provided with one pass 14 through which a cryogenic heat transfer fluid passes. As could be appreciated by those skilled in the art, condenser 12 or any other heat exchanger to be utilized in connection with the present invention could incorporate more than one pass. In freer dryer 1, the cryogenic heat transfer fluid is nitrogen vapor.

The nitrogen vapor is introduced into condenser 12 through the use of a reversing circuit 16 of the cryogenic _heat transfer system. Reversing circuit 16 has an inlet 18 and an outlet 20. A tree of first, second, third and forth solenoid operated valves 22, 24, 26 and 28 are provided. When first and second valves 22 and 24 are open, nitrogen vapor flows into inlet 18, through first valve 22, through pass 14, back through second valve 24 and out of outlet 20. When first and second valves 22 and 24 are closed and third and fourth valves 26 and 28 are open, nitrogen vapor flows through inlet 18, third valve 26, pass 14 of condenser 12 in the opposite flow direction, back through fourth valve 28, and then out of outlet 20. It is to be noted that alternative valving arrangements could be used such as three-way valves.

A portion of the nitrogen vapor is recirculated while a remaining portion of the nitrogen vapor is vented preferably through an adjustable pressure relief valve 30. Pressure relief valve 30 is adjusted to maintain an elevated pressure within the cryogenic heat exchange system and thereby to minimize pressure drop and flow velocity within the heat exchanger. The maintenance of pressure also allows exhaust nitrogen vapor to be delivered at a sufficiently high delivery pressure so as to be used elsewhere in an installation either utilizing either freeze dryer 1 or a cryogenic heat exchange system in accordance with the present invention. As can be appreciated by those skilled in the art, venting could also be controlled by other valving such as a regulating valve or a pressure switch/valve combination.

Cryogenic heat exchange system is also provided with an ejector 32 to effect circulation of the nitrogen vapor acting as cryogenic heat transfer fluid. Ejector 32 has a high pressure inlet 34 and a low pressure inlet 36. Additionally ejector 32 is also provided with a diffuser section 37 for pressure recovery. Diffuser section 37 terminates in an outlet 38 for discharging the cryogenic heat transfer fluid. The recirculated portion of the cryogenic fluid is drawn into low pressure inlet 36 of ejector 32 by a low pressure region produced within ejector 32. Although not illustrated, such low pressure region is produced by a venturi effect due to the flow of incoming cryogen entering ejector 32 through high pressure inlet 34. Other venturi-type devices, having high and low pressure inlets, a low pressure region for mixing, and a high pressure outlet, not necessarily termed "ejectors" could serve the same purpose as ejector 32. In the illustrated embodiment, the incoming cryogen is liquid nitrogen supplied at a gauge pressure of about 1035 kilopascals and a temperature of about −185° C. High and low pressure inlets 34 and 36 and diffuser section 37 all communicate with the low pressure region, designated by reference number 40. Low pressure region 40 serves as a mixing chamber in which incoming cryogen, which may in fact be in a vapor form, mixes within the portion of the spent cryogenic heat transfer fluid, that is nitrogen vapor after having passed through condenser 12 to thereby form the cryogenic heat transfer fluid. The pressure of the cryogenic heat transfer fluid is to some extent recovered in diffuser section 37 and is then discharged to high pressure outlet 38 which serves as an outlet of the mixing chamber. High pressure outlet 38 is connected to inlet 18 of reversing circuit 16.

As can be appreciated, such mixing also increases the enthalpy of the cryogenic heat transfer fluid to be circulated over the enthalpy of the entering liquid nitrogen. As mentioned previously, the increase in enthalpy coupled with flow reversal promotes uniform ice formation on condenser 12. In a proper application of the present invention, the same principal could be used to provide a cryogenic heat exchanger with a self-defrost function.

Ejector 32 is preferred because it has no moving parts and heat transfer is efficiently conducted between the incoming cryogen and the cryogenic heat transfer fluid. As can be appreciated by those skilled in the art it is possible to substitute apparatus having an equivalent function to ejector 32 such as a separate pump and mixing chamber. However, such other possible embodiments of the present invention would have an increased degree of complexity as well as increased operating costs over the illustrated embodiment.

In order to produce a maximum circulation capability, the cryogenic heat exchange system can also be provided with a recirculation heat exchanger 42 to heat the entering liquid cryogen by heat exchange with the portion of the cryogenic heat transfer fluid being recirculated. Since no heat is being transferred outside the system, the total cooling capacity of the cryogen is condensed. Recirculation heat exchanger 42 has first and second passes 44 and 46. First pass 44 is connected to high pressure inlet 34 and second pass 46 is in communication between low pressure inlet 36 and outlet 20 of reversing circuit 16. In the illustrated embodiment, first and second passes 44 and 46 extend in the same direction but preferably, can be set up in a countercurrent flow relationship to transfer a maximum heat from the portion of recirculated cryogenic heat transfer fluid and the entering liquid nitrogen. This heat transfer increases the enthalpy of the liquid nitrogen which increases its motive capacity and thereby increases the rate of recirculated flow within the cryogenic heat exchange system. The degree of circulation and therefore a further control of the temperature of the cryogenic heat transfer fluid can be provided by a proportional valve 48.

As can be appreciated, the condenser 12, reversing circuit 16, ejector 32, associated piping and etc. are all generic to a discussion of any cryogenic heat exchange system in accordance with the present invention. Any cryogenic heat exchange system of the present invention could have the same layout as the foregoing elements but used in applications other than freer drying. For instance, a heat exchanger having one or more passes could be connected to a reversing circuit 16 and an ejector such as ejector 30 to cool foodstuffs passing through one or more cooling ducts. A pressure relief valve 30 and a recirculation heat exchanger 42 could optionally be provided.

While the invention has been discussed with reference to a preferred embodiment, it will be understood by those skilled in the art that numerous additions, changes and omissions can be made without departing from the spirit and scope of the invention.

I claim:

1. A cryogenic heat exchange system comprising:

a heat exchanger having at least one pass for receiving a cryogenic heat exchange fluid;

a reversing circuit connected to the at least one pass having an inlet for receiving the cryogenic heat exchange fluid, means for introducing the cryogenic heat transfer fluid into the at least one pass and for reversing flow direction of the cryogenic heat transfer fluid so that the cryogenic heat exchange fluid flows through the at least one pass in one flow direction and then in an opposite flow direction, and an outlet for receiving a portion of the cryogenic heat transfer fluid from the at least one pass after having passed therethrough as spent cryogenic heat exchange fluid;

recirculation means connected to the outlet of the reversing circuit for receiving the spent cryogenic heat transfer fluid and having a mixing chamber for mixing the spent cryogenic heat transfer fluid with a cryogen, to form the cryogenic heat exchange fluid and thereby to increase the enthalpy of the cryogenic heat transfer fluid over that of the cryogen, a mixing chamber outlet in communication with the inlet to the reversing circuit for introducing the cryogenic heat transfer fluid into the reversing circuit, and means for circulating the cryogenic heat transfer fluid to the reversing circuit, through the at least one pass and back to the mixing chamber as the spent cryogenic heat exchange fluid; and vent means for venting a remaining portion of the cryogenic heat transfer fluid after having passed through the at least one pass of said at least one heat exchanger.

2. The cryogenic heat exchange system of claim 1, wherein said recirculation means comprises a venturi-type device having a high pressure inlet for receiving the cryogenic liquid, a low pressure inlet for connected to the outlet of the reversing circuit for drawing the spent cryogenic heat transfer fluid, a low pressure region serving as the mixing chamber and in communication with the high and low pressure inlets, and a high pressure outlet, the high pressure outlet serving as the mixing chamber outlet and connected to the inlet of the reversing circuit for discharging the cryogenic heat transfer fluid into the reversing circuit.

3. The heat exchanger of claim 1, wherein said reversing circuit comprises:

a pair of fast and second valves connecting the at least one pass between the inlet and outlet of the recirculation means such that when said first and second valves are set in an open position, said cryogenic heat transfer fluid flows through said at least one pass in the one flow direction; and a pair of third and fourth valves also connecting the at least one pass between the inlet and outlet of the recirculation means such that when said first and second valves are set in an closed position and said third and fourth valves are set in an open position, said cryogenic heat transfer fluid flows through said at least one pass in the opposite flow direction.

4. The cryogenic heat exchange system of claim 3, wherein said recirculation means comprises a venturi-type device having a high pressure inlet for receiving the cryogenic liquid, a low pressure inlet for connected to the outlet of the reversing circuit for drawing the spent cryogenic heat transfer fluid, a low pressure region serving as the mixing chamber and in communication with the high and low pressure inlets, and a high pressure outlet, the high pressure outlet serving as the mixing chamber outlet and connected to the inlet of the reversing circuit for discharging the cryogenic heat transfer fluid into the reversing circuit.

5. The cryogenic heat exchange system of claim 4, further comprising a recirculation heat exchanger having a first pass connected to the high pressure inlet of the ejector and a second pass communicating between the outlet of the reversing circuit and the low pressure inlet of the ejector for exchanging heat between the cryogen and the spent cryogenic heat transfer fluid prior to said ejector to increase the enthalpy of the ejector.

6. A freer dryer comprising:

a freezing chamber for subjecting substances to a freer drying process in which moisture contained within the substances is frozen and sublimated into a vapor;

a condenser in communication with said freezing chamber for freezing the vapor and for accumulating said vapor as ice, said condenser having at least one pass for receiving a cryogenic heat transfer fluid for freezing said vapor;

a reversing circuit connected to the condenser and having an inlet for receiving the cryogenic heat exchange fluid, means for introducing the cryogenic heat transfer fluid into the at least one pass of the condenser and for reversing flow direction of the cryogenic heat transfer fluid so that the cryogenic heat transfer fluid flows in one flow direction and then in an opposite flow direction, thereby to promote a uniform accumulation of the ice on said condenser, and an outlet for receiving a portion of the cryogenic heat transfer fluid from the condenser as spent cryogenic heat exchange fluid;

recirculation means connected to the outlet of the reversing circuit for receiving the spent cryogenic heat transfer fluid and having a mixing chamber for mixing the spent cryogenic heat transfer fluid with a cryogen to form the cryogenic heat transfer fluid and thereby to increase the enthalpy of the cryogenic heat transfer fluid over that of the cryogen, a mixing chamber outlet in communication with the inlet to the reversing circuit for introducing the cryogenic heat transfer fluid into the reversing circuit, and means for circulating the cryogenic heat transfer fluid to the reversing circuit, through the at least one pass of the condenser, and back to the mixing chamber as the spent cryogenic heat exchange fluid; and vent means for venting a remaining portion of the cryogenic heat transfer fluid after having passed through the at least one pass of the condenser.

7. The freeze dryer of claim 6, wherein said recirculation means comprises an ejector having a high pressure inlet for receiving the cryogenic liquid, a low pressure inlet for connected to the outlet of the reversing circuit for drawing the spent cryogenic heat transfer fluid, a low pressure region serving as the mixing chamber and in communication with the high and low pressure inlets, and a diffuser section in communication with the low pressure region and terminating in a high pressure outlet, the high pressure outlet serving as the mixing chamber outlet and connected to the inlet of the reversing circuit for discharging the cryogenic heat transfer fluid into the reversing circuit.

8. The freer dryer of claim 6, wherein said reversing circuit comprises:

a pair of first and second valves connecting the at least one pass between the inlet and outlet of the recirculation means such that when said first and second valve are set in an open position, said cryogenic heat transfer fluid flows through said at least one pass in the one flow direction; and a pair of third and fourth valves connecting the at least one pass between the inlet and outlet of the recirculation means such that when said first and second valves are set in a closed position and said third and fourth valves are set in an open position, said cryogenic heat transfer fluid flows through said at least one pass in the opposite flow direction.

9. The freeze dryer of claim 8, wherein said recirculation means comprises a venturi-type device having a high pressure inlet for receiving the cryogenic liquid, a low pressure inlet for connected to the outlet of the reversing circuit for drawing the spent cryogenic heat transfer fluid, a low pressure region serving as the mixing chamber and in communication with the high and low pressure inlets, and a high pressure outlet, the high pressure outlet serving as the mixing chamber outlet and connected to the inlet of the reversing circuit for discharging the cryogenic heat transfer fluid into the reversing circuit.

10. The freeze dryer of claim 9, further comprising a recirculation heat exchanger having a first pass connected to the high pressure inlet of the ejector and a second pass communicating between the outlet of the reversing circuit and the low pressure inlet of the ejector for exchanging heat between the cryogen and the spent cryogenic heat transfer fluid prior to said ejector to increase the enthalpy of the ejector.

* * * * *